US006012526A

United States Patent [19]

Jennings et al.

[11] Patent Number: 6,012,526

[45] Date of Patent: Jan. 11, 2000

[54] METHOD FOR SEALING THE JUNCTIONS IN MULTILATERAL WELLS

[75] Inventors: Steven L. Jennings, Friendswood; James Kenneth Whanger, Houston, both of Tex.; Arne Larsen, Tananger, Norway; John L. Baugh, Houston, Tex.; Brian Wood, Tornaveen Torphins, United Kingdom; Christopher L. Gann; Darrin Willauer, both of The Woodlands, Tex.; Mark W. Brockman, Houston, Tex.; David G. Forsyth, Aberdeen, United Kingdom; Gerald D. Lynde, Houston, Tex.; Douglas J. Murray, Humble, Tex.; Edwin Schubrick, Spring, Tex.; James K. Jackson, Calgary, Canada; William K. Brown, Muscat, Oman

[73] Assignee: Baker Hughes Incorporated, Houston, Tex.

[21] Appl. No.: 08/909,777

[22] Filed: Aug. 12, 1997

Related U.S. Application Data

[60] Provisional application No. 60/023,859, Aug. 13, 1996, and provisional application No. 60/044,168, Apr. 21, 1997.

[51] Int. Cl.[7] ..... E21B 43/11; E21B 43/114; E21B 43/119

[52] U.S. Cl. ..... 166/298; 166/53; 166/55.1; 166/55.7; 166/297

[58] Field of Search ..... 166/50, 53, 55, 166/55.1, 55.7, 55.8, 297, 298

[56] References Cited

U.S. PATENT DOCUMENTS

| | | | |
|---|---|---|---|
| 2,397,070 | 3/1946 | Zublin | 166/50 |
| 2,452,920 | 11/1948 | Gilbert . | |
| 2,797,893 | 7/1957 | McCune et al. | 166/50 X |
| 2,858,107 | 10/1958 | Colmerauer | 166/50 |
| 3,330,349 | 7/1967 | Owsley et al. . | |
| 4,396,075 | 8/1983 | Wood et al. | 166/50 X |
| 4,402,551 | 9/1983 | Wood et al. | 299/5 |
| 4,415,205 | 11/1983 | Rehm et al. | 299/5 |
| 4,436,165 | 3/1984 | Emery | 175/61 |
| 4,444,276 | 4/1984 | Peterson, Jr. | 175/61 |
| 4,573,541 | 3/1986 | Josse et al. | 175/78 |
| 4,577,388 | 3/1986 | Wood | 166/55 X |
| 4,630,676 | 12/1986 | Long, Jr. | 175/77 X |
| 4,648,454 | 3/1987 | Yarnell | 166/297 |
| 4,701,988 | 10/1987 | Wood | 166/55.8 X |
| 4,807,704 | 2/1989 | Hsu et al. | 166/313 |
| 5,289,876 | 3/1994 | Graham | 166/276 |
| 5,301,760 | 4/1994 | Graham | 175/51 |
| 5,318,122 | 6/1994 | Murray et al. | 166/313 |
| 5,337,808 | 8/1994 | Graham . | |
| 5,474,131 | 12/1995 | Jordan, Jr. et al. | 166/313 |
| 5,477,925 | 12/1995 | Trahan et al. | 166/382 |
| 5,526,880 | 6/1996 | Jordan, Jr. et al. | 166/291 |
| 5,803,176 | 9/1998 | Blizzard, Jr. et al. | 166/298 |
| 5,833,003 | 11/1998 | Longbottom et al. | 166/298 |

FOREIGN PATENT DOCUMENTS

| | | |
|---|---|---|
| A-40168/93 | 6/1993 | Australia . |
| 1 501 504 | 2/1978 | United Kingdom . |
| 2 282 835 | 4/1995 | United Kingdom . |
| 2 297 779 | 8/1996 | United Kingdom . |
| 2 304 764 | 3/1997 | United Kingdom . |

*Primary Examiner*—George Suchfield
*Attorney, Agent, or Firm*—Cantor Colburn LLP

[57] ABSTRACT

Junctions in multilateral well structures are sealed by employing a variety of degrees of premachined components and a variety of sealing embodiments, including casing segments having premachined windows, side pocket members which are adapted to reside within the string during run in and move laterally to the deployed position, woven members, cement filled ECPs, etc. Also disclosed is a downhole milling device which cuts a window in a casing segment or other material based upon a predetermined geometric pattern imposed upon the cutting tool by an integral template.

13 Claims, 9 Drawing Sheets

122
147
146
148
124
120
130
10
134
132
140
144
138
120
180
116
150
118
112

METHOD FOR SEALING THE JUNCTIONS IN MULTILATERAL WELLS

CROSS-REFERENCE TO RELATED APPLICATIONS

This application claims the benefit of an earlier filing date from U.S. Provisional Application Serial No. 60/023,859 filed Aug. 13, 1996 and U.S. Provisional Application Serial No. 60/044,168 filed Apr. 21, 1997. The entire contents of each of these provisional applications is incorporated herein by reference.

BACKGROUND OF THE INVENTION

1. Filed of the Invention

This invention relates generally to the completion of junctions between primary and lateral wellbores. More particularly, this invention relates to new and improved methods and devices for sealing the junction of a branch wellbore extending laterally from a primary well which may be vertical, substantially vertical, inclined or even horizontal. This invention finds particular utility in the sealing of junctions of multilateral wells, that is, downhole well environments where a plurality of discrete, spaced lateral wells extend from a common primary wellbore.

2. Prior Art

Lateral well drilling and production have been increasingly important to the oil industry in recent years. While lateral wells have been known for many years, only relatively recently have such wells been determined to be a cost effective alternative (or at least companion) to conventional well drilling. Although drilling a lateral well costs substantially more than its vertical alternative, a lateral well frequently improves well productivity by several fold. Lateral drilling provides the means for enhancing field economics by accessing and developing reservoirs that would otherwise be uneconomic to develop using conventional drilling and completion practices. Hydrocarbon reservoirs that are ideal candidates for lateral technology are those that are thin and limited in size, multi faulted, or naturally fractured. Other reasons for employing laterals are to address reservoir vertical conformance, oil and gas coning potential and sweep efficiency. Environmental issues, such as the number of drilling sites in sensitive areas can also be addressed with lateral technology. In addition, improved field development economics can be achieved in large reservoirs using multiple laterals by improving the productivity of individual wells thereby reducing investment and operational costs.

Some wells contain additional wellbores extending laterally from the lateral. These additional lateral wells are sometimes referred to as drain holes and primary wells containing more than one lateral well are referred to as multilateral wells. Multilateral wells are becoming increasingly important, both from the standpoint of new drilling operations and from the increasingly important standpoint of reworking existing wellbores including remedial and stimulation work.

As a result of the foregoing increased dependence on and importance of lateral wells, lateral well completion, and particularly multilateral well completion have posed important concerns and have provided (and continue to provide) a host of difficult problems to overcome. Lateral completion, particularly at the juncture between the primary and lateral wellbore is extremely important in order to avoid collapse of the well in unconsolidated or poorly consolidated formations. Thus, open hole completions are limited to competent rock formations; and even then, open hole completions are inadequate in many cases since there is limited control or ability to re-access (or re-enter) the lateral or to isolate production zones within the well. Coupled with this need to complete lateral wells is the growing desire to maintain the size of the wellbore in the lateral well as close as possible to the size of the primary wellbore for ease of drilling and completion.

Conventionally, lateral wells have been completed using either slotted liner completion, external casing packers (ECP's) or cementing techniques. The primary purpose of inserting a slotted liner in a lateral well is to guard against hole collapse. Additionally, a liner provides a convenient path to insert various tools such as coiled tubing in a lateral well. Three types of liners have been used: (1) perforated liners, where holes are drilled in the liner, (2) slotted liners, where slots of various width and depth are milled or wire wrapped along the liner length, and (3) prepacked liners.

Slotted liners provide limited sand control through selection of hole sizes and slot width sizes. However, these liners are susceptible to plugging. In unconsolidated formations, wire wrapped slotted liners have been used to control sand production. Gravel packing may also be used for sand control in a lateral well. The main disadvantage of a slotted liner is that effective well stimulation can be difficult because of the open annular space between the liner and the well. Similarly, selective production (e.g., zone isolation) is difficult.

Another option is a liner with partial isolations. External casing packers (ECPs) have been installed outside the slotted liner to divide a long lateral well bore into several small sections. This method provides limited zone isolation, which can be used for stimulation or production control along the well length. However, ECP's are also associated with certain drawbacks and deficiencies. For example, normal lateral wells have many bends and curves. In a hole with several bends it may be difficult to insert a liner with several external casing packers.

Finally, it is possible to cement and perforate medium and long radius wells, as shown, for example, in U.S. Pat. No. 4,436,165.

The problem of lateral wellbore (and particularly multilateral wellbore) completion has been recognized for many years as reflected in the patent literature. For example, U.S. Pat. No. 4,807,704 discloses a system for completing multiple lateral wellbores using a dual packer and a deflective guide member. U.S. Pat. No. 2,797,893 discloses a method for completing lateral wells using a flexible liner and deflecting tool. U.S. Pat. No. 2,397,070 similarly describes lateral wellbore completion using flexible casing together with a closure shield for closing off the lateral. In U.S. Pat. No. 2,858,107, a removable whipstock assembly provides a means for locating (e.g., re-entry) a lateral subsequent to completion thereof. U.S. Pat. No. 3,330,349 discloses a mandrel for guiding and completing multiple lateral wells. U.S. Pat. No. 5,318,122, which is assigned to the assignee hereof and incorporated herein by reference, discloses deformable devices that selectively seal the juncture between the primary and lateral wells using an inflatable mold which utilizes a hardenable liquid to form a seal, expandable memory metal devices or other devices for plastically deforming a sealing material. U.S. Pat. Nos. 4,396,075; 4,415,205; 4,444,276 and 4,573,541 all relate generally to methods and devices for multilateral completion using a template or tube guide head. Other patents and patent applications of general interest in the field of lateral well completion include U.S. Pat. Nos. 2,452,920, 4,402,551, 5,289,876, 5,301,760, 5,337,808, Australian patent application 40168/93, U.S. application Ser. No. 08/306,497 filed Sep. 15, 1994, now U.S. Pat. No. 5,526,880, which is assigned to the assignee hereof and incorporated herein by reference, and U.S. Ser. No. 08/188,998 filed Jan. 26, 1994, now U.S. Pat. No. 5,474,131, which is also commonly assigned and incorporated herein by reference.

Notwithstanding the above-described attempts at obtaining cost effective and workable lateral well completions, there continues to be a need for new and improved methods and devices for providing such completions, particularly sealing between the juncture of primary and lateral wells, the ability to re-enter lateral wells particularly in multilateral systems) and achieving zone isolation between respective lateral wells in a multilateral well system.

Some of the most recent developments include the following: one method for cementing the junction between the main borehole and the lateral borehole addresses the issue of creating a window in the main (or primary) hole, drilling a lateral wellbore and then sealing the juncture between the lateral and primary wellbores to have the ability to re-enter each lateral wellbore as well as to maintain the option to perform any function that could be done in a single wellbore. For this reason, cemented lateral wellbores are desirable so that normal isolation, stimulation or any other operation can be achieved.

In accordance with this prior art method, prior to running in a novel "hook" liner system described hereinafter, a standard whipstock is used to mill out a window in the side of the casing of the primary wellbore at the location where it is desired to drill a lateral wellbore.

In accordance with this prior art method, prior to running in a hook hanger system (fully described in U.S. Pat. No. 5,477,925, and briefly described hereinafter) a standard whipstock is used to mill a window in the side of the casing of the primary wellbore at the location where it is desired to drill a lateral wellbore.

The hook liner hanger is run on top of the lateral liner. The liner is run into the main casing and then out through the aforementioned milled window. The hook liner hanger has a pre-machined window, a hook system, and a re-entry system. When the hook on the hanger locates on the main casing milled window, it orients the hanger, so that the pre-machined window is aligned with the lower part of the main casing below the milled window. The running system for the hook liner hanger, includes a method of isolating the pre-machined window from the bore of the hook liner hanger. If desired the liner can be cemented in place, using standard cementing techniques commonly used in regular liner placements. The hook liner hanger can be run in various combinations to suit the needs of the wellbore. These combinations can include equipment such as external casing packers, sand control screens, partially cemented liner, fully cemented liner, and liner hanger packers.

When the hook hanger is to be cemented in place, a tube is attached to the lower end of the liner hanger running tool that extends below the pre-machined window. The annular space between the tube and the Liner Hanger body is sealed, so that the cement does not circulate back through the pre-machined window. After the cement has been pumped in place, the tube can be pulled back above the pre-machined window and then diverted back down through the pre-machined window to clean out the flow path back to the main casing below the milled window.

A variation of the hook liner hanger is a version where the formation can be hydraulically sealed from the lateral liner, the lower main casing and the upper main casing. A short section of casing extends from the periphery of the pre-machined window in the hook liner hanger. The end of this section is cut obliquely so that when being run it is possible to run inside the main wellbore casing, yet when landed will still extend from the hook liner hanger. After the hook liner hanger is fully positioned and any cementing has taken place, a tie back assembly is employed which will go through the pre-machined window in the hook liner hanger and land in the packer positioned below the window which was initially positioned for the whipstock. When the anchor lands in the packer it will orient in the same manner as the whipstock did. The orientation will also align a seal system which will land in the short section of casing extending from the hook liner hanger. The seal system can be of any of the common types such as a packing element, chevron seal system, or an interference seal system.

The "hook" liner hanger system includes a "hook" and is run into the wellbore and then through the aforementioned milled window. The "hook" liner hanger system is run into the lateral wellbore until the "hook" hanger locates on the milled window in the main primary wellbore. Inside the "hook" liner hanger system is a tail pipe assembly with adjustable opposing swab cups. The tail pipe assembly carries liquid cement or other fluids as required to inflate external casing packers or other devices as required. The end of the "hook" hanger liner is then plugged to allow the hydraulic set hanger to set by means of applied pressure. An external casing packer located near the end of the "hook" liner hanger system is then inflated to seal the lateral wellbore annular space just below the cementing valve of the "hook" liner hanger system. Opposing "swab-cups" are used to direct fluid to inflate the external casing packer.

The tailpipe assembly string is then withdrawn high enough to allow the end of the tailpipe assembly string to be pulled from the lateral wellbore and then lowered into the main wellbore through the premilled window of the "hook" liner hanger system to assist in reducing debris from falling into the main wellbore. While the system does create a good sealed junction it is a difficult process and an easier and more speedy process is always desirable.

U.S. Pat. No. 5,318,122 discloses a number of embodiments employing differing forms and hardenable filling materials. The methods include employing 1) an inflatable mold which utilizes a hardenable liquid like epoxy or cement; 2) expandable memory metal devices; 3) swaging devices for plastically deforming a sealing material; 4) liner seals for sealing between the liner and the primary bore; and 5) side pocket devices to guide a liner into the lateral.

All of the prior art devices and methods while performing well for their intended functions are still in need of improvement. A particular area of improvement desired is in the cement at the junction which in present art is employed as both the junction and the seal. This works marginally well and is subject to failure due to limitations in the cement material itself or the ability to place the cement successfully at the junction. More particularly, under the conditions downhole, cement can fail by deteriorating to such an extent that the seal begins to leak thus contaminating the production. Therefore it is desirable to provide alternate junction creating and sealing arrangements which may be more reliable and improved performance under downhole conditions.

SUMMARY OF THE INVENTION

The above discussed drawbacks and deficiencies of the prior art are overcome or alleviated by the methods and apparati of the invention.

In a first set of embodiments of the invention a multilateral sealed premachined window is disclosed. The method involves machining the outline of a window in a piece of casing such that all that remains in the outline is a very thin piece of the original wall. The fact that casing remains helps to prevent debris from entering the inside area of the casing during running of the primary casing and machining operations downhole such as drilling, milling, etc. On the inside of the window a feature is provided to facilitate the removal and retrieval of the window. The method provides a very clean window through which tools may pass and against which seals may rest. Similar embodiments include machining a perforated pattern in the casing and sealing the holes with a dissolvable compound or even machine the entire window and cover the opening with an easily drillable or dissolvable compound. The system allows for both maintaining pressure integrity of the completion while the tool is run in hole and provides a precise window shape making sealing thereagainst more easily attainable. The arrangement also benefits from the fact that the window piece removed is withdrawn uphole and therefore leaves minimal or no debris.

In an alternate embodiment of the first set of embodiments, a window in the casing can be machined with a downhole milling machine comprising a template having a groove in which a pin glides to direct movement of a cutting tip to ensure that the window is cut in a predetermined set of parameters such as size and shape. Use of the system avoids questions about the shape of the window and ensures a good sealing surface. The milling machine is driven by electric means, pneumatic means or by hydraulic means and is preferably held against the casing by hydraulically actuated pads.

In a second set of embodiments, a multilateral compression sealed junction is discussed. An elastomeric seal is bonded on the O.D. of a premachined window or on the liner; the liner includes a wedge or a plurality of unidirectional collapsible fingers oriented such that either the wedge or the fingers may pass through the window in the outward direction only. Drawing the liner back uphole seats the wedge or fingers against the elastomeric seal deforming the same radially inwardly to effect a pressure tight seal. The inward deflection of the elastomeric seal can be assisted, if desired, by the addition of a flange radially outwardly of the seal against which the seal will bear preventing radially outward movement of the seal. Thus, the only available direction for the compression expansion of the seal is radially inward. In order to maintain the produced pressure tight seal the liner may be anchored in the main bore via a number of methods and apparati known per se (e.g. packers, hangers, etc.) and the liner is then cemented in place. Alternatively, the liner may be supported by the string which placed it while it is being cemented in place. Subsequent to cementing, the liner segment remaining in the primary hole is drilled out to regain communication with the primary bore lower than the lateral.

In another set of embodiments, a multilateral side pocket sealed junction is disclosed. A side pocket is supported on a casing in a hinged arrangement such that the side pocket is maintained within the casing adjacent to a premachined window for run in and is then displaceable outwardly through the premachined window until an elastomeric seal is put in contact with the casing thus sealing the junction. The formation is preferably underreamed prior to completion to provide room for the side pocket to swing into the deployed position. Once the side pocket is set a diverter of a known variety is employed to kick a string into the lateral through the window and junction. Benefits of the method include a round sealing surface at the exit point of the side pocket. This allows reliable and simple seal formation at the liner-side pocket intersection.

An alternative of the side pocket embodiment bonds an elastomeric material to the side pocket to the window to create the seal while the tool is at the surface. The side pocket is then pushed straight into the window to the inside of the casing, stretching the seal. The tool is run in hole in this condition and may then be deployed by simply pushing the side pocket out by means of a running tool. An advantageous seal design for this arrangement allows the stretched seal to be trapped between the casing and the side pocket.

Another alternative is to mount the side pocket in the run in position and completely cover the window with elastomeric material bonding the material to the casing and to the side pocket at every part of the surface where the rubber touches the side pocket. To deploy this tool the side pocket is pushed through the cover and the lateral is extended through the rubber. Because the rubber is bonded everywhere on the side pocket, however, a good seal is maintained between the side pocket and the main casing. Once the lateral is cemented, the elastomer and cement act in concert to maintain the seal at the junction.

In still another junction sealing set of embodiments, a sock of braided or woven material bonded in rubber is attached to a premachined window in a casing segment by, for example, an adhering compound, and in some cases by also wrapping the woven material around the casing exterior for extra strength. Preferably, but not necessarily, the other end of the sock is attached to a ring slightly smaller than the minor diameter of the window but larger than the O.D. of the liner. The ring is used to facilitate a pressure tight seal on the O.D. of the liner. Drilling operations are completed while the sock is in an inverted position and attached in the I.D. of the primary casing. When a liner is run, pins are sheared and the sock is displaced to the outside of the casing segment. Preferably the liner either by itself or with a feature designed for the purpose, pulls (or pushes depending upon the readers disposition) the ring and sock through the window. As the sock stretches, and due to the woven nature of the sock, a "Chinese finger cuff" action is realized which creates a good seal for the junction by tightening the sock around the liner. Additionally, a rubber seal may be added on the ring if desired as an added sealing feature.

In another embodiment of the sock of the invention, the sock is not completely inverted but is merely pushed into the main casing until the ring is at least flush with the outer diameter of the casing. In this case the ring may be pinned to the protective sleeve instead of the casing itself, the sleeve being then anchored in the casing by other known methods and apparati.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several Figures.

DETAILED DESCRIPTION OF THE PREFERRED EMBODIMENTS

Figure 1:
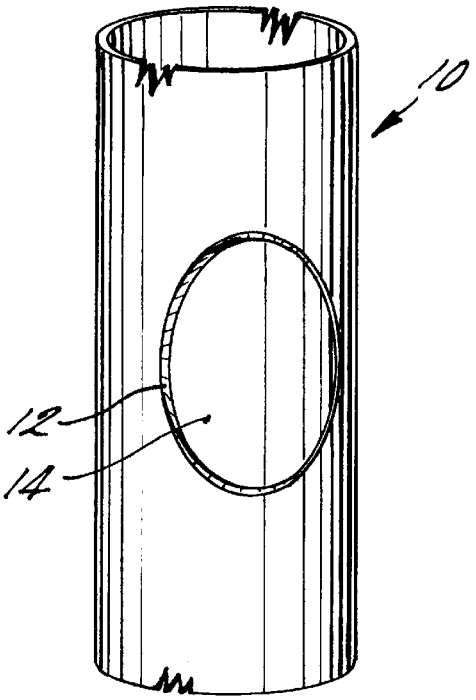
FIG. 1 is a perspective view of a first alternative of the first set of embodiments of the invention.

With reference to FIG. 1, one of skill in the art will appreciate casing 10. The casing of the invention includes groove 12 cut therein in the outline of a window for a prospective lateral borehole. Preferably, the depth of the groove relative to the thickness of casing material is in the range of about 1% to about 15% of the entire thickness of the casing material. The range of groove depth is preferred in order to retain sufficient strength of the window cover during run in yet allow for relatively easy removal at the desired time.

Figure 1A:
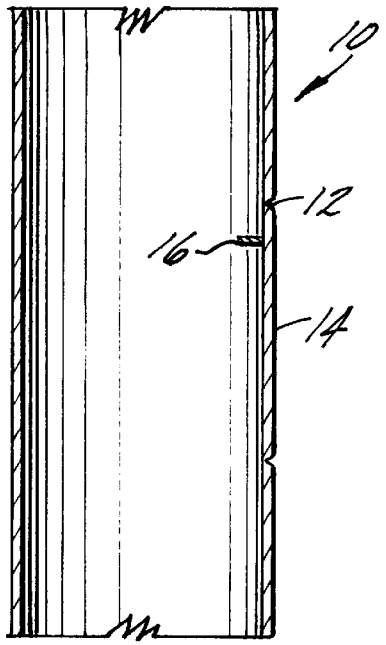
FIG. 1*a* is a cross-section view of FIG. 1 illustrating internal features.

To facilitate removal of the window pane 14, a removal feature 16 is provided on the interior of the casing 10 attached to pane 14. Reference to FIG. 1A will provide one example of feature 16 but it is cautioned that in no way is the invention limited to the type of feature 16 shown. Rather the feature 16 may be of any shape or placement that may facilitate locating the window cover and it's removal. Moreover, feature 16 may be a groove or a plurality of grooves used to locate and retrieve the window. It should also be understood that the feature is not critical to operation of this embodiment of the invention. Feature 16 may be omitted and the window cover removed by other means. In the preferred arrangement, however, the feature is present since removal of the window pane 14 uphole and out of the well becomes an easier proposition in that instance.

Subsequent to removing the window a clean premachined surface is provided against which conventional tools may bear and in conjunction with which sealing procedures may be carried out.

Figure 2:
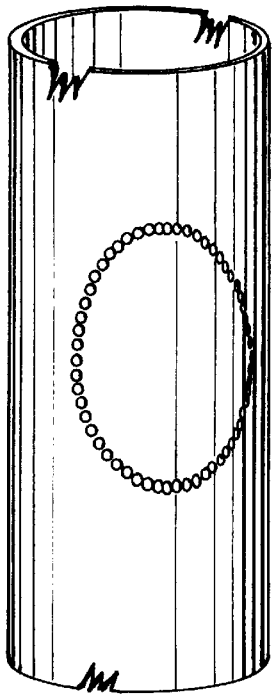
FIG. 2 is a perspective view of the second alternative of the first set of embodiments of the invention.

In an alternate embodiment of FIG. 1, illustrated in FIG. 2; the groove 12 is substituted for by a perforated pattern. Preferably the perforations are filled with a sealing compound to prevent exchange of fluids from inside to outside of the casing 10.

Figure 3:
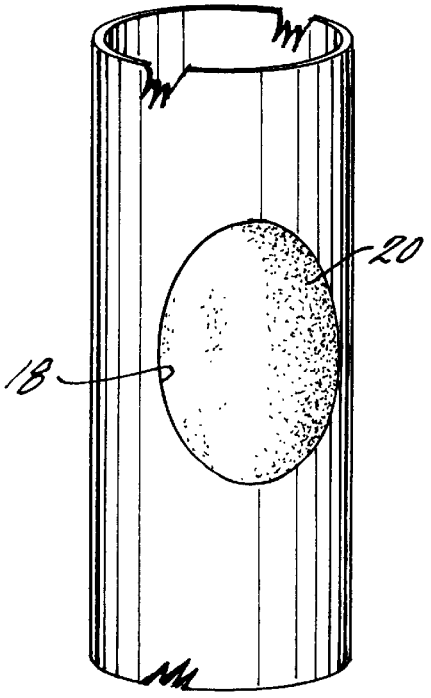
FIG. 3 is a perspective view of the third alternative of the first set of embodiments of the invention.

In another alternate embodiment, (FIG. 3) the premachining of the window is completed so that an actual window is present in casing 10. The window opening 18 is preferably sealed with an easily drillable or dissolvable compound such as nitrile or zinc. Because of the removability of the window covering 20, damage is not done to the premachined window and superior sealing thereagainst may be accomplished.

In another alternate embodiment of the invention which provides a dimensionally ensured window, the window is not pre-machined but rather is machined downhole by a templated milling machine. It will be understood that the machine may be employed where no premachining has been done or to finish the window where premachining has been done.

In a second set of embodiments of the invention (FIGS. 4–6) a compression seal is effected by employing either a wedge or a multiplicity of unidirectional fingers to compress a preferably rubber seal. It will be understood that the wedge embodiment may employ a rubber seal and may be employed without such seal.

Figure 4:
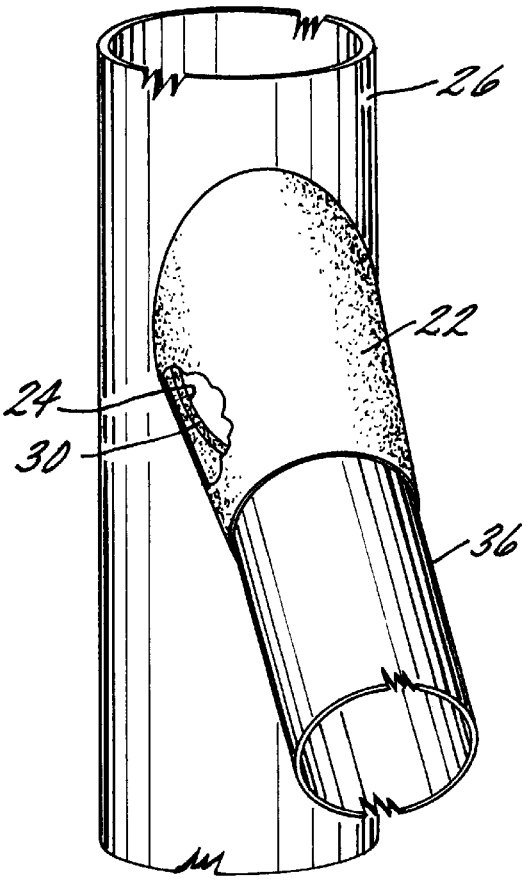
FIG. 4 is a perspective view of a compression seal embodiment of the invention.

Referring to FIG. 4, the wedge 22 is preferably made of an at least moderately deformable material. The wedge 22 must deform in one direction to allow it to pass through the window 24 in the casing 26. Once through the window, wedge 22 may be drawn back against casing 26. Where wedge 22 is constructed of a suitable sealing material a separate seal is not necessary. Where wedge 22 is constructed from a material not suited for sealing a separate seal (not shown) should be provided either on the casing 26 or at the edge 30 of the wedge 22 proximal to the casing 26. Wedge 22 is attached to liner 36 in the predetermined position preferably by bonding. The aforementioned alternates will provide a pressure tight seal upon wedge 22 being drawn uphole against casing 26 after having passed through window 24. In general, an HR liner running tool 32 (commercially available from Baker Oil Tools, Houston, Tex., depicted in FIG. 6) is preferred both for run in and pulling back on the liner to create the seal.

Figure 5:
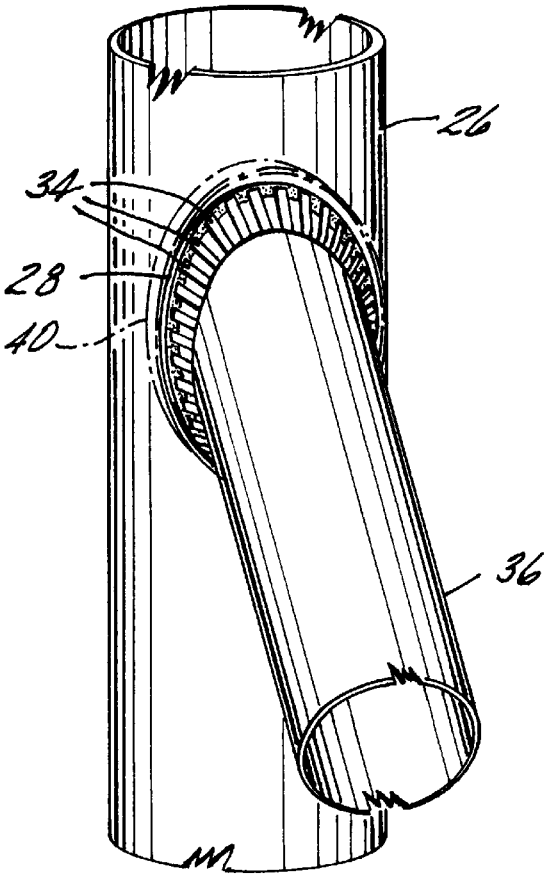
FIG. 5 is a perspective view of an alternate compression seal embodiment of the invention.
Figure 6:
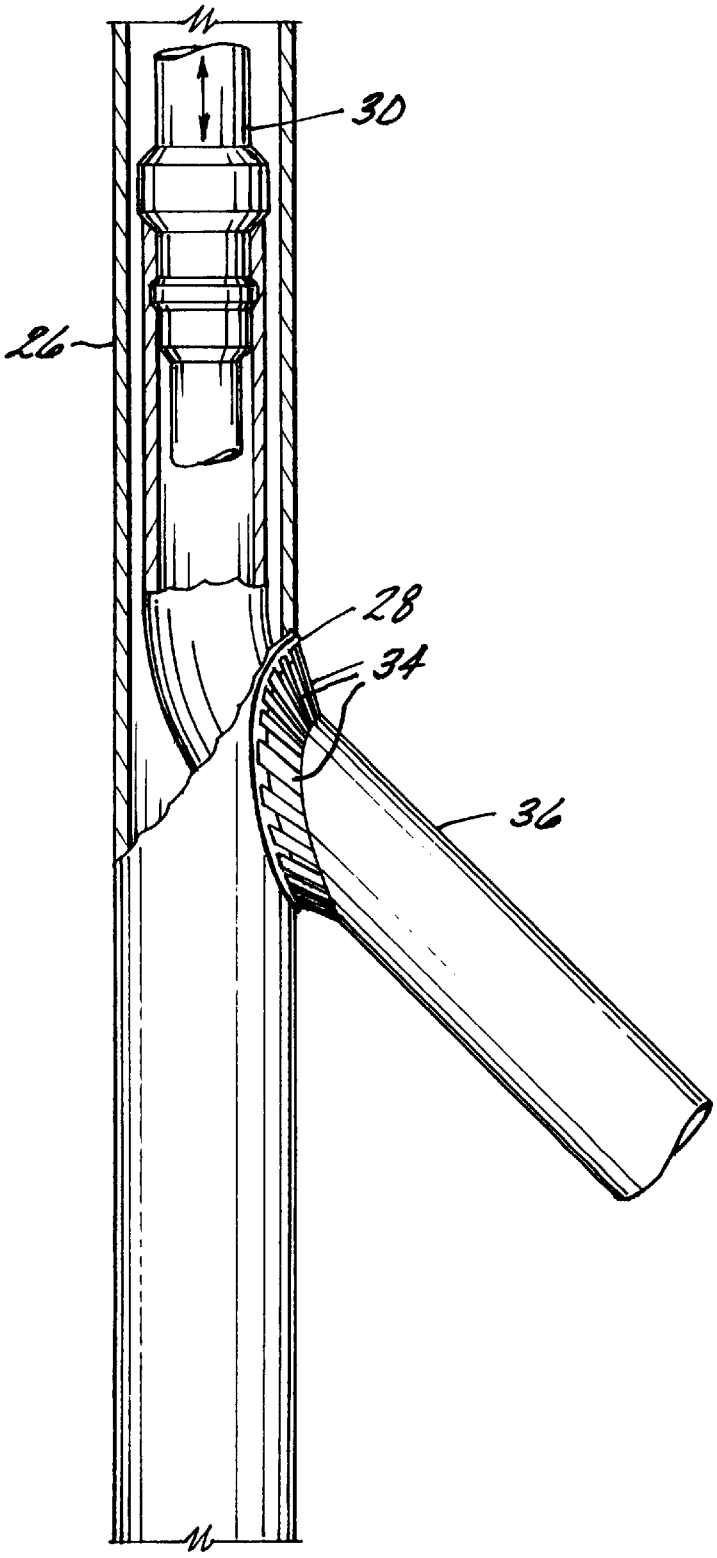
FIG. 6 is an elevation view of a prior art HR liner running tool engaged with a liner of the invention.
Figure 7:
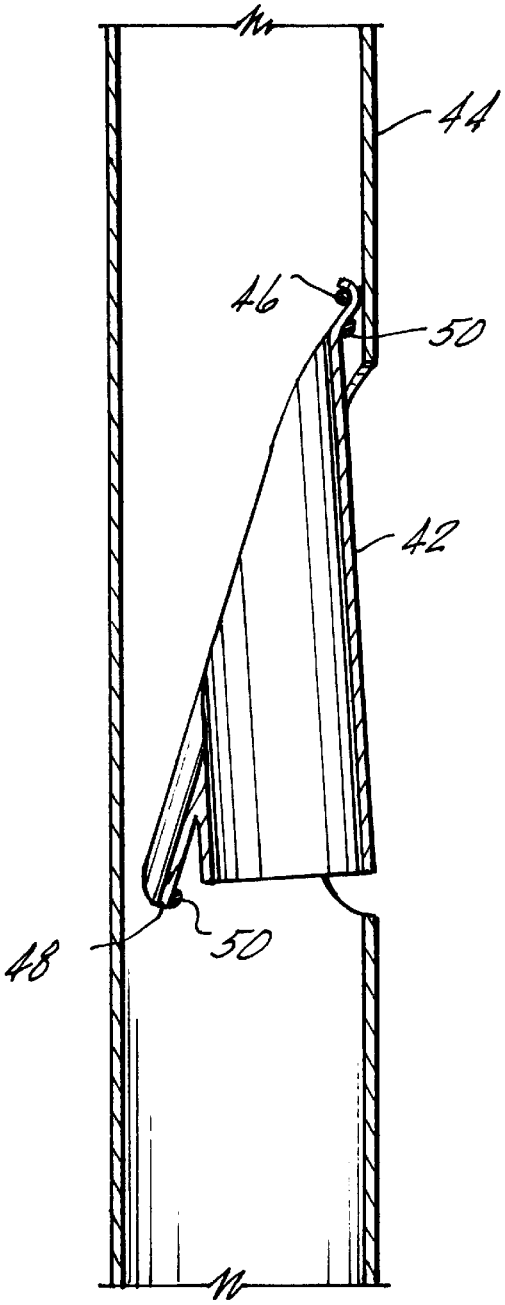
FIG. 7 is a cross-section view of a side pocket tool of the invention in the run in position.
Figure 8:
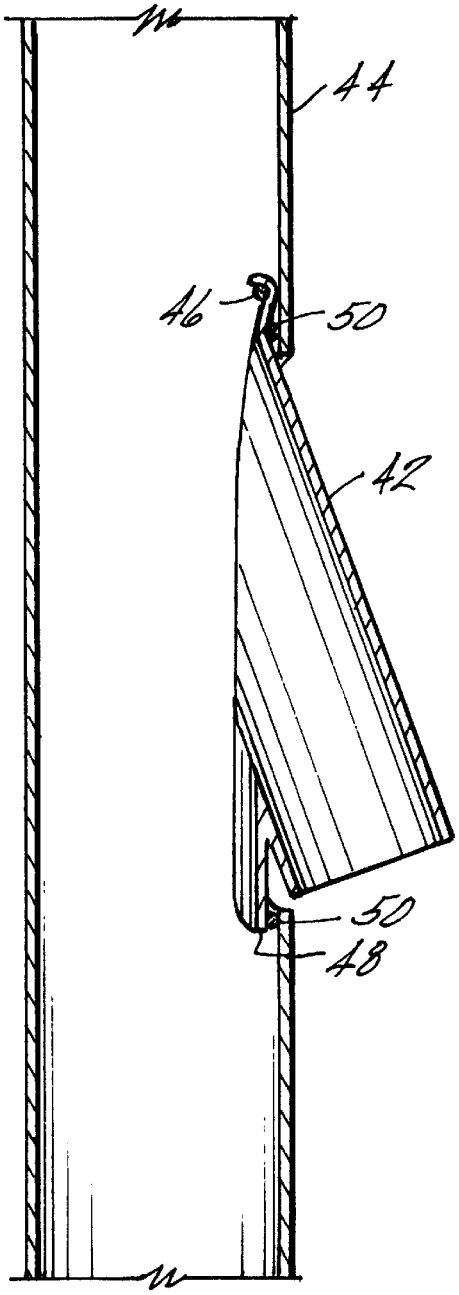
FIG. 8 is a view of the tool in FIG. 7 in the deployed position.
Figure 9:
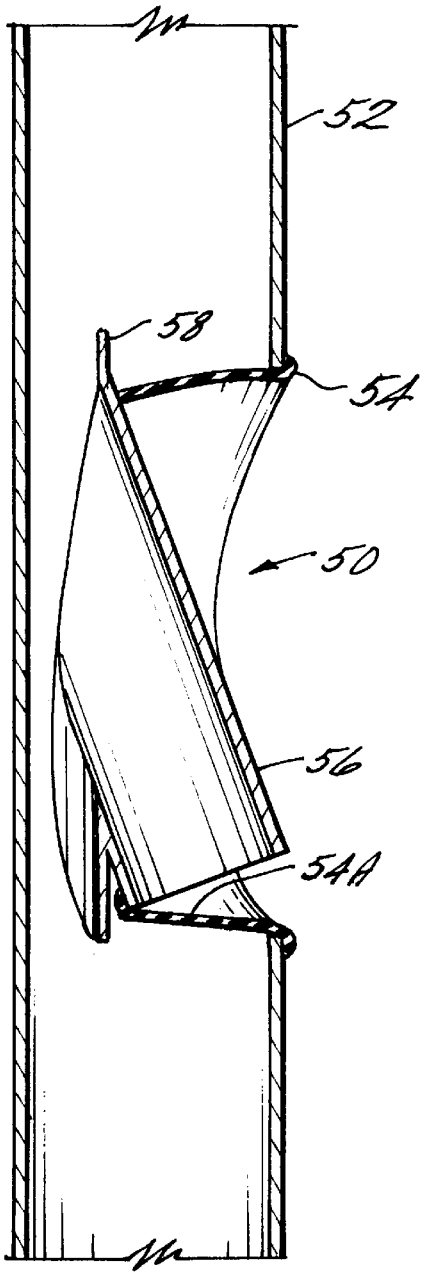
FIG. 9 is a cross-section view of an alternative side pocket junction seal of the invention in the run in position.
Figure 10:
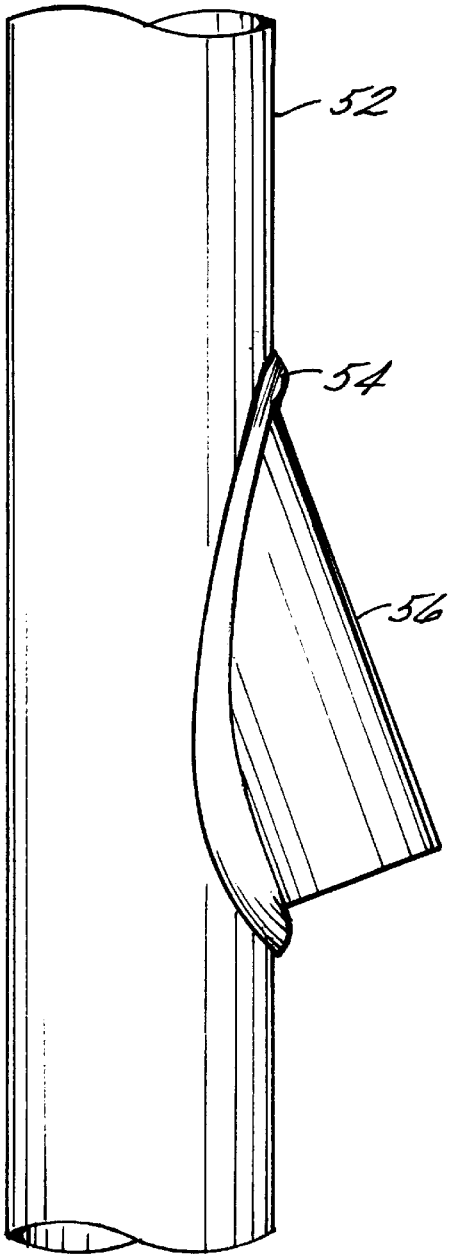
FIG. 10 is an elevation view of FIG. 9 in the deployed position.

In an alternate embodiment, referring to FIGS. 5 and 6, wedge 22 is replaced by unidirectional collapsible fingers 34 which project in the uphole direction and are attached to liner 36, the attachment being of any kind but most preferably by welding. Fingers 34 slide through the window by collapsing, they then spring outwardly once they have cleared the window. When the liner is drawn back, the fingers are pulled against the casing and provide a compressive force, as does wedge 22, on the sealing area of the casing 26 around window 24. A rubber seal 28 is preferably bonded to casing 26 but may be bonded to the fingers or even may be loosely hung around the liner.

It is desirable to facilitate a radially inwardly expanding movement of the seal 28 to near exclusion of radially outward movement to ensure a good seal. Thus, it is desirable, but not necessary, to provide a flange 40 around the window 24 to eliminate radially outward movement of seal 28. Flange 40 is illustrated in FIG. 5 in Phantom.

For both alternative embodiments the liner is held uphole by the HR tool 32 until cementing is completed whereafter wedge 22 or fingers 34 will maintained permanently in a position where a compressive seal is achieved against casing 26.

In a third set of embodiments, referring to FIGS. 7–10, side pockets are employed in various methods to effect a sealed junction. In the first alternate, illustrated in FIGS. 7 and 8, the side pocket 42 is hinged to casing 44 at hinge 46. Hinge 46 allows side pocket 42 to swing from the run in position of FIG. 7 to the deployed position of FIG. 8.

To facilitate sealing of the arrangement, side pocket 42 includes flange 48 on what will be the only part of side pocket 42 to remain inside casing 44 when the device is in the deployed position. Flange 48 provides a bearing surface for elastomeric seal 50 designed to mate with casing 44. It will be appreciated that seal 50 should be oval and concave to provide a good seal against the interior surface of casing 44.

For run in, preferably, side pocket 42 is held inside casing 44 with any conventional pinning or locking arrangement, in order to reduce the overall size of the tool during run in. The tool will be deployed in a previously underreamed section of borehole. Underreaming is important to the system because the tool in the deployed position is significantly larger in radial dimension than the drilled hole in typical wells. Deployment of the tool will preferably be by a known setting tool many of which are commercially available from Baker Oil Tools, Houston, Tex. The shear arrangement will be sheared by the impetus of the setting tool and side pocket 42 will swing into the deployed position. It is preferable to support the pocket 42 with a locking sleeve type arrangement inside the casing to maintain the integrity of the seal by urging the side pocket against the casing wall. The invention provides a reliable simple and effective junction seal.

An alternative side pocket sealed junction, still requiring underreaming of the target area, pushes the side pocket straight out through the window and does not employ a hinge arrangement. Most preferably, referring to FIGS. 9 and 10, the device is created by premachining a window 50 in casing 52 and bonding an elastomeric seal 54 to both casing 52 and side pocket 56. The side pocket will be in the deployed position during device construction. Then the side pocket 56 is pushed into the lumen of casing 52, stretching the elastomeric seal to the extent indicated in FIG. 9 by 54*a* in order to allow the side pocket to completely reside in the interior of the casing. Side pocket 56 is preferably pinned or locked in place and is thus protected for the run in of the tool.

A setting or running tool is employed to release the side pocket (not shown) and to push the pocket 56 out of casing 52 into the deployed position. In one preferred arrangement seal 54 is bonded outside casing 52 around window 50 and to side pocket 56. In this embodiment, after seal 54 is stretched, the stretched part 54*a* will remain inside casing 52, doubled on itself, thereby creating a compression seal between side pocket flange 58 and casing 52.

An alternate arrangement bonds the elastomer inside of the casing and adjacent the window 50 and to the flange 58 of side pocket 56. The result is a less stretched elastomeric seal which may be desirable for some applications and conditions.

Figure 12:
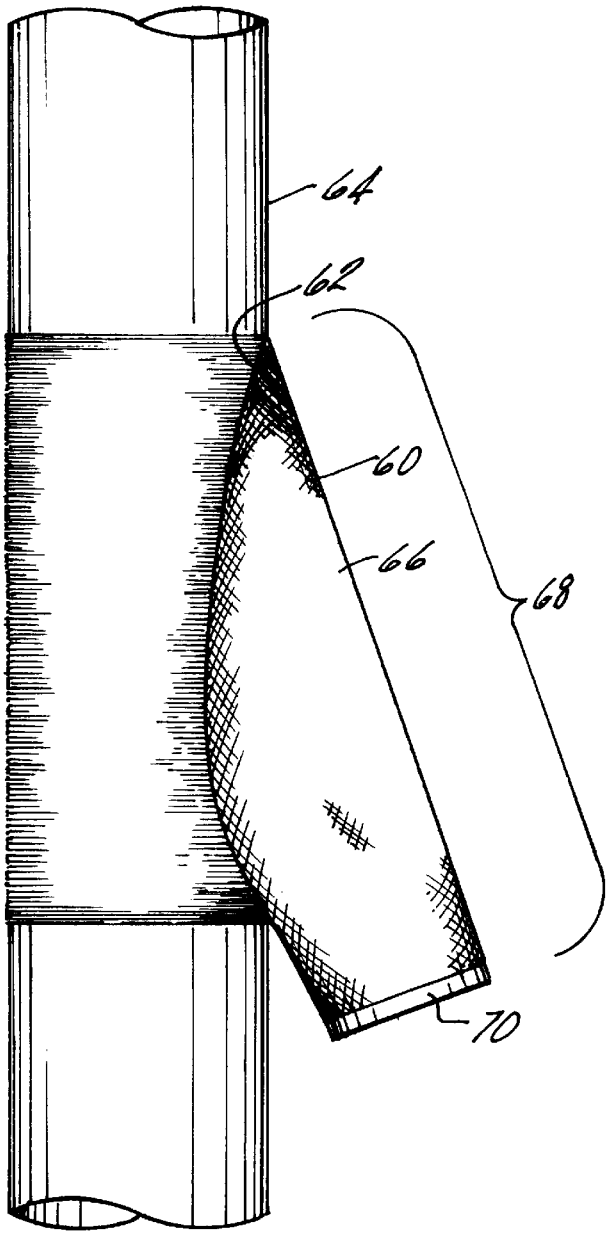
FIG. 12 is an elevation view of a sock sealed junction device of the invention in the deployed position.

In a fourth set of embodiments (see FIGS. 11 and 12) a sock sealed junction is disclosed.

A sock sealed junction provides woven or braided cables bonded in a seal material, preferably of elastomeric construction. The preferred bonding elastomer is nitrile and the preferred composition of the cables is steel, carbon fiber, kevlar, etc. In general the material for the cables is selected for its tensile strength, heat resistance, abrasion resistance and chemical deterioration resistance. Particular resistances preferred include acids solvents and oils. Particular attributes for the preferred materials are elasticity and bonding strength. The cables 60 wind around one another in a pattern similar to a Chinese finger lock. At the proximal end of sock 62, cables 60 may be joined to casing 64. The joining maybe carried out in a number of ways but preferably are welded to casing 64. The seal material must be bonded to casing 64 to create the necessary seal.

Cables 60 are bonded within elastomer 66 which provides the desired seal. In the most preferred embodiment, the sock 68 includes a metal (or other suitable material) ring 70 for creating a seal against the liner (not shown) that passes therethrough. A seal may be attached to the ring or a seal bore may be provided in the ring to receive a seal from the liner. The seal bore can be a polished bore to use conventional sealing techniques.

Figure 11:
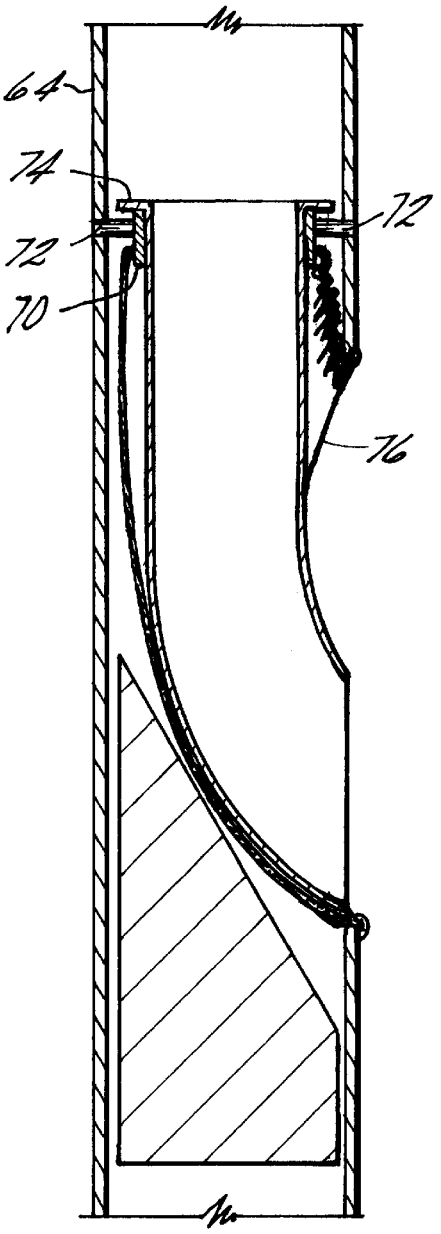
FIG. 11 is a cross section view of a sock sealed junction device of the invention in the run in position.

Construction of the sock sealed junction is carried out in the deployed position. Once the sock is attached and sealed to the casing 64, the entire sock is inverted (FIG. 11) into the inside of casing 64. Ring 70, in addition to its sealing function, is employed as an anchor point for temporary attachment of the sock inside the casing. In FIG. 11 pins 72 are illustrated. Once sock 68 has been inverted and pinned, a protector sleeve 74 is inserted from the uphole end of the device through the sock and through the window 76. Sleeve 74 protects the sock and the ring from being damaged by the drill string while it is passing through the window 76. Protector sleeve 74 can also utilize a flexible rubber outer diameter to make contact with the casing interior and prevent drilling debris from damaging the sock. A diverter/whipstock is placed below (downhole of) window 76 to assist in directing the drill string through the window to drill the lateral.

The lateral section in close proximity to the window is underreamed to provide space for the sock to be deployed. The sock device is run in hole in the inverted position and held there by an attachment means until the lateral borehole is fully drilled. Attachment means can be anything capable of supporting the sock in the inverted position and subsequently be induced to release the sock for deployment. Then protector sleeve 74 is drawn out of the hole and a liner (not shown) is run on a conventional liner running tool. As the liner pushes through the ring it carries the sock to the right-side-out position. Moreover, as the liner continues to move downhole the sock 68 is extended and because of the woven construction thereof, constricts around the liner to create a good seal for the junction.

The area between the sock I.D. and liner O.D. may also be filled with cement, epoxy or some other material to enhance the sealing/joining characteristics of the junction.

Figure 13:
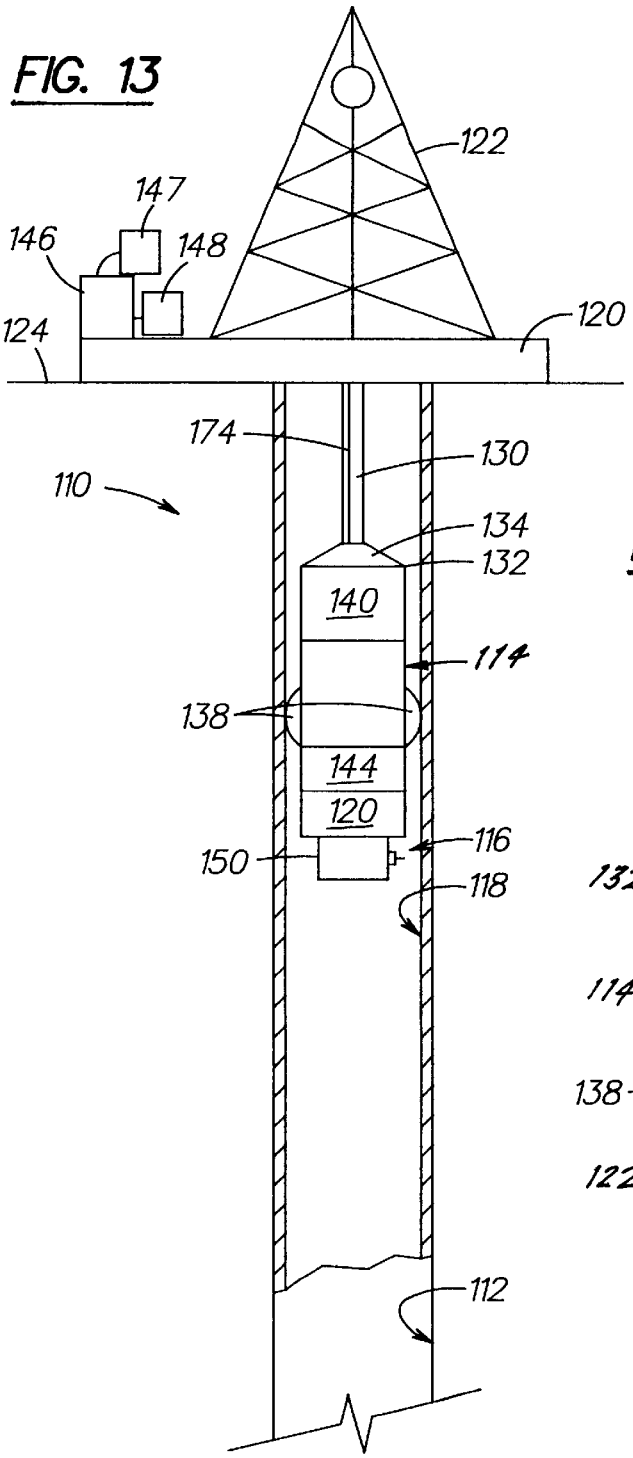
FIG. 13 is a schematic diagram of an embodiment of a milling device with a cutting tool positioned in a wellbore for cutting a section from the wellbore casing.

FIG. 13 is a schematic diagram of a system 110 for cutting or milling materials in a wellbore 112. The system 110 incorporates a downhole milling device 114, containing a cutting tool 116 (FIG. 14), which is positioned in the wellbore 112 at a predetermined distance from the material to be cut. For ease of understanding, the following description of this embodiment of the invention refers to this material to be cut as a casing 118 but as will be understood by one of skill in the art, following exposure to this disclosure, other materials can be cut with this invention. The term casing 118 is employed by way of example and is not intended to limit the scope of the invention.

Referring to FIG. 13, the system 110 shown therein includes the downhole milling device (herein referred to as the "milling device") 114 conveyed from a platform 120 of a derrick 122 into the wellbore 112 by a suitable conveyor 130, such as tubing or wireline, and positioned adjacent the part of casing 118 to be cut. The system is adaptable to employ any known means for providing proper orientation and location prior to milling the window.

Figure 14:
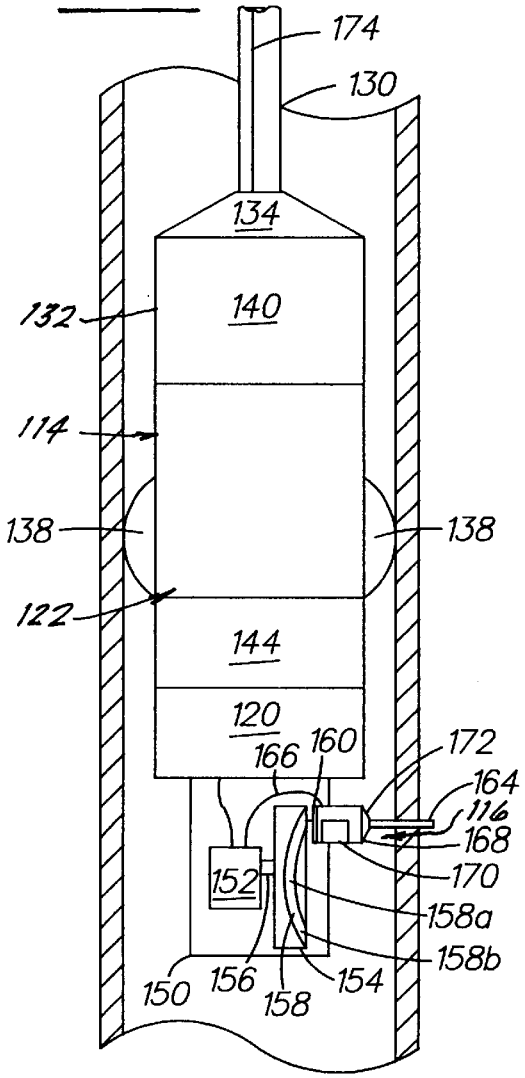
FIG. 14 is a partial cross-sectional side view of the milling device having a cutting template installed.

As illustrated in FIG. 14, the milling device 114 has a tubular housing 132, which is connected with the conveyor 130 via a suitable connector 134. The housing 132 contains the various support elements for the milling device 114, such as a power section 120 for supplying energy to the cutting tool 116 and other components as described below. The particular energy preferred is electricity which is suppliable by TEC wire, batteries, capacitors or generators, but it will be understood that hydraulic or pneumatic power sources can also be employed.

Figure 15:
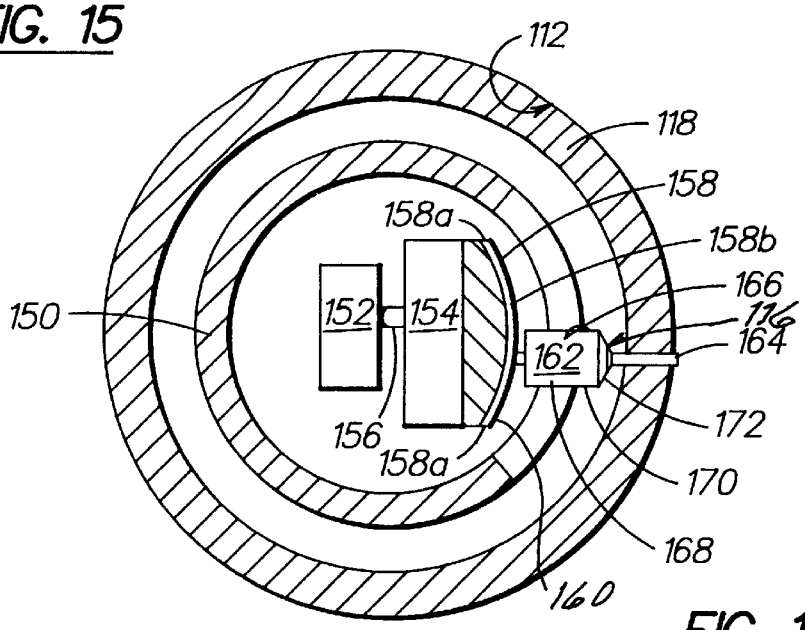
FIG. 15 is a partial cross-sectional top view of the cage portion of FIG. 14 showing the positioning of some of the components of the milling device with respect to the casing.

As illustrated in FIGS. 14–15, a cage 150 attached to the lower part of the housing 132 contains a control unit 152 for controlling the vertical and radial position of the cage 150, a template 154 and the cutting tool 116. The cutting tool 116 may be continuously positioned and oriented at the desired location near the casing 118 by control circuitry 121 contained in the downhole milling device 114 and/or at the surface 124 (FIG. 13).

The control unit 152 uses a template arm 156 to urge the template 154 and the cutting tool 116 against the casing 118 and to maintain the required pressure to keep the cutting tool 116 in place. A groove 158 in the template 154 emulates the geometry of the cutting profile desired to be cut into the casing 118. A template guide pin 160, located at one end of the cutting tool 116 and seated in the groove 158, is attached to a cutting tool 162 which holds a cutting element 164. The cutting tool body 162 is connected to the control unit 152 via a control line 166 and contains a motor 168, gears 170 and a tool holder 172.

There are many different devices, well-known in the industry, that can be used as the cutting element 164, such as a milling cutter or drill (for mechanical cutting FIGS. 14–15) for mechanical cutting or a nozzle (not shown) for the concentrated discharge of a high-pressure fluid therefrom in the form of a jet stream having a relatively small cross sectional area. The drill and the nozzle are examples and are not intended to limit the scope of the invention. Any cutting apparatus adaptable for use in the industry may be used with this invention.

For the majority of downhole cutting or milling applications, water discharged at a pressure greater than 110,000 psi may be adequate to remove materials from within the wellbore 112. In cutting casing 118 casings may be more than one-half inch thick), higher pressure may be required. The nozzle may be made strong enough to withstand discharge pressures of greater than 200,000 psi.

An orientation section 144 can be placed above the power section 120 for orienting the cage 150 and the cutting tool 116 at the desired position such that the template 154 is properly aligned with the casing 118. Cage 150 containing the cutting tool 116 and the template 154, is rotated about the axis of the wellbore 12 to radially position the cutting tool 116 and the template 154. Cage 150 is then moved axially to position cutting tool 116 and template 154 along the axis of the wellbore 112. Downhole hydraulically operated devices or electric motors (not shown) have been utilized for performing such functions and are well known in the industry. Any such suitable device may be utilized for the purpose of this invention.

In the configuration shown in FIG. 13, the cutting tool 116 can cut materials along the interior of the wellbore 112, which may include the casing 118 or an area around a junction between the wellbore 112 and a branch wellbore, (not shown).

A surface control unit 146, as shown in FIG. 13, placed at a suitable location on the platform 120 preferably controls the operation of the system 110. The surface control unit 146 can include a computer, associated memory, a recorder for recording data and a display or monitor 147. Suitable alarms 148 are coupled to the surface control unit 146 and are selectively activated by the surface control unit 146 when certain predetermined operating conditions occur. The operation of control units, such as the surface control unit 146, is well known and is, thus, not described in detail herein.

The operation of the cutting system 110 will now be described with respect to cutting a section or window in the casing 118 while referring to FIGS. 13–15. A cutting profile defining the desired cutting shape is formed as a groove 158 in the template 154 and installed with the control unit 152 in the cage 150 of the milling device 114. The milling device 114 then is conveyed downhole via conveying means 130 and positioned such that the groove 158 in the template 154 is aligned with the desired area to be cut in the casing 118. Stabilizers 138 then are set to ensure minimal radial movement of the milling device 114 in the wellbore 112 during the cutting operations. It should be noted that stabilizers 138 are preferably hydraulically actuated packer-type elements however they may also be electrically actuated solenoids or screw devices or could even by pneumatically actuated. Any means of biasing the system 110 to the cutting side is sufficient.

The control unit 152 is activated to position the template 154 and the cutting tool 116 such that the cutting element 164 is urged against the casing 118. The cutting element 164 is then activated to generate the desired cutting action as the cutting tool 116 is moved along the groove 158 in the template 160. In the preferred embodiment, the cutting tool 116 is moved along the groove 158 by the action of the gears 170. Control signals can be sent to the gears 170 and the motor 168 in the cutting tool 116 via the control line 166.

Figure 16A:
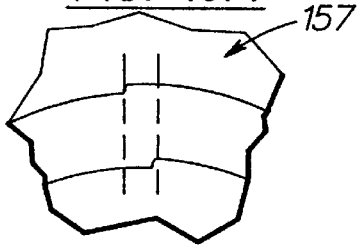
FIG. 16A is an enlarged view of a portion of FIG. 16 taken along circumscription 16A—16A.
Figure 16:
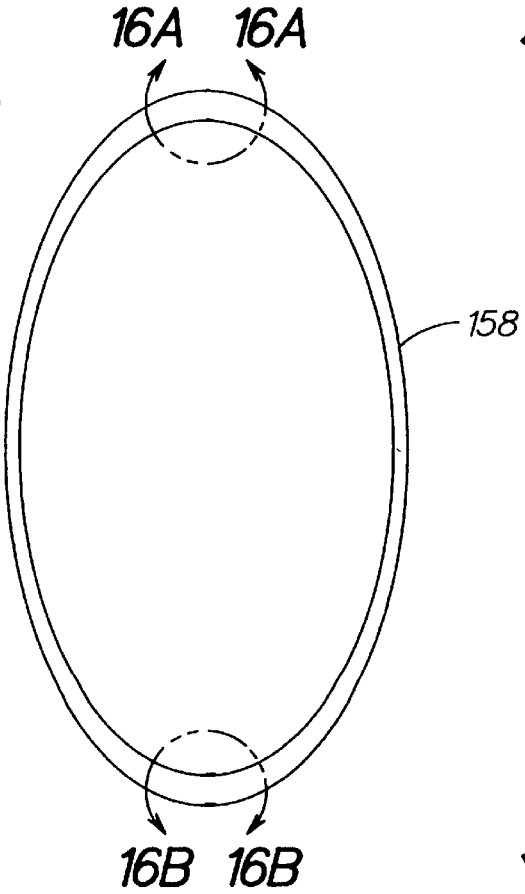
FIG. 16 is a schematic view of an oval groove.
Figure 16B:
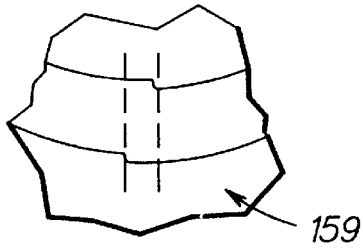
FIG. 16B is an enlarged view of a portion of FIG. 16 taken along circumscription 16B—16B.

A cross-sectional top view of the cage 150 portion of the milling device 114 is shown in FIG. 15. In this illustration, a circular cut is to be made in the casing 118. Therefore, the groove 158 slopes downward from outer points **158*a* to a point 158*b* which is the bottom most point of the groove 158. The flexibility of the template 160 and the groove 158 combination provide the ability to emulate any 3-dimensional profile. Therefore, cuts can be made into materials with irregular surfaces and the cuts can be made of any outline. Therefore, cutting is no longer limited to circular cutting as it is with some of the prior art. Referring to FIGS. 16, 16A and 16B, one will appreciate that where the milling tool is moved via movement of the string from the surface, additional profiles are necessary in groove 158. Exemplary illustrations of this type of arrangement are shown as 157 and 159**. A brief review of the features illustrated will provide understanding to one of skill in the art. As the following pin arrives at one end of the oval it slips into the trough of the feature. Thus when it is tensioned it cannot slide back into the half of the oval it came from but rather must proceed to the opposite side of the oval. It should also be noted that these features are directional and if a specific direction of movement of the cutter is necessary the features must be modified accordingly.

If the section to be cut is such that it will remain in the position after it has been cut (due to the presence of a cement bond or other impediment), or if the cut section can be dropped to the wellbore bottom as debris, then the system 110 may be set so that the cutting tool 116 makes additional cuts within the periphery of the defined profile such that the section of casing 118 is cut into pieces that are small enough to be transported to the surface by circulating a fluid (not shown) through the wellbore 112, as is commonly done for such purpose.

During operations, the downhole control unit 152 can communicate with the surface control unit 146 via two-way telemetry 174 or any other communication technique. The downhole controls for the telemetry 174 are preferably contained in a downhole telemetry section 140.

Figure 17:
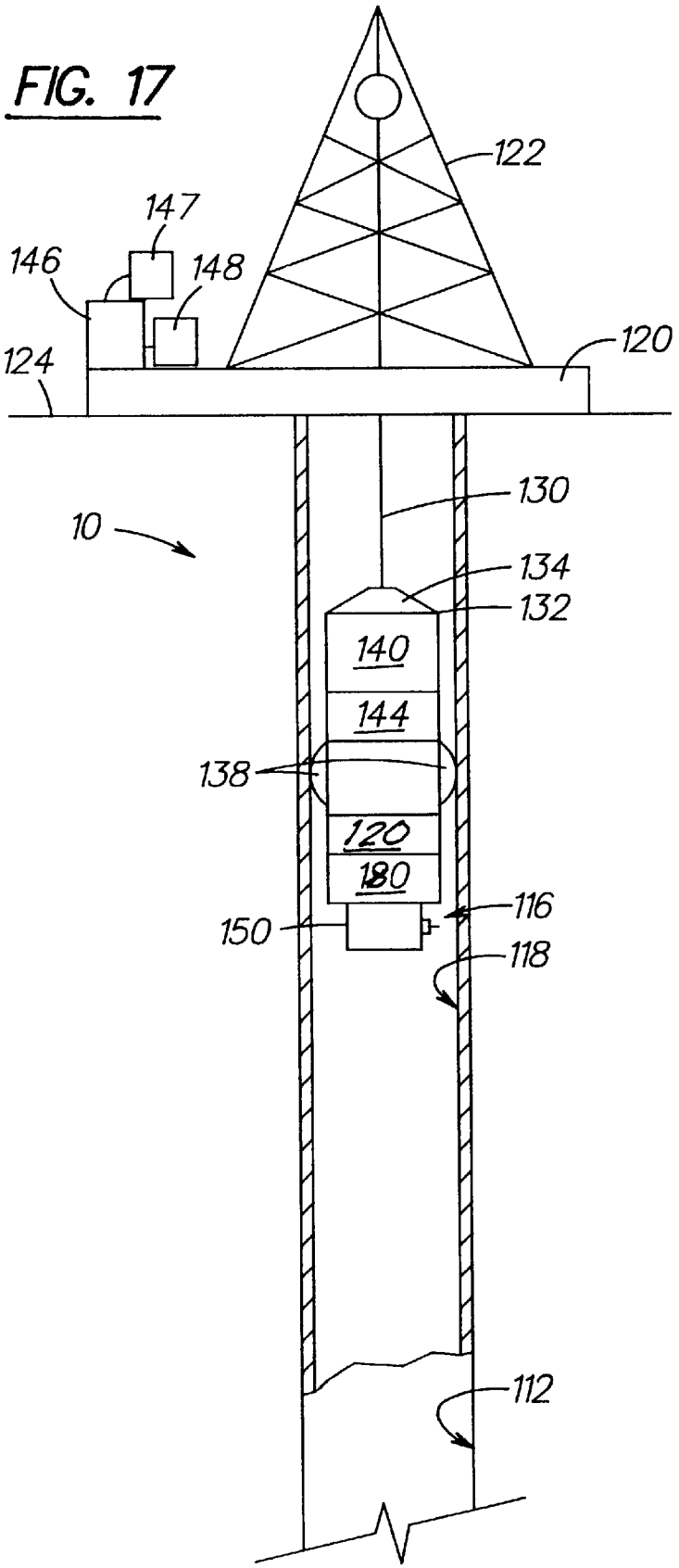
FIG. 17 illustrates a second preferred embodiment that utilizes an imaging device as part of the milling device.

FIG. 17 shows the downhole tool of FIG. 13 with an imaging device 180 attached above the cage 150. Tools for imaging portions of a wellbore interior exist in the field and, therefore, will not be described in detail. The imaging device can be utilized to confirm the shape of the section of the casing or the junction after the cutting operation has been performed. The imaging device may also be utilized to first image the area to be cut to generate the desired cutting profile and then to confirm the cut profile after the cutting operation.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A downhole tool comprising:

a) a template configured to be disposable downhole and adjacent a prospective window site;

b) a downhole milling tool guided by said template; and c) a controller in communication with said milling tool to control operation of said milling tool.

2. A downhole tool as claimed in claim 1 wherein said template includes features which facilitate one way circumscription by said milling tool in a groove of said template.

3. A downhole tool as claimed in claim 1 wherein said milling tool includes a drive which moves said tool within a groove in said template.

4. A downhole tool as claimed in claim 1 wherein said controller is mounted to said template.

5. A milling tool for cutting a desired pattern in a material in a wellbore, comprising:

a) a template having a preformed groove that corresponds geometrically to the desired pattern; and b) a cutting tool having a first end positioned within the groove and a second end having a cutter, wherein the cutting tool is guided along the groove in the template to make the desired patterned cut in the material.

6. The milling tool of claim 5, further comprising a locator adapted to orient the cutting tool at a predetermined position in the wellbore for effecting the cutting of the material.

7. The milling tool of claim 5, further having a driver to drive the cutting tool radially within the wellbore.

8. The milling tool of claim 7, further having a driver to move the cutting tool in an axial direction with respect to the wellbore axis.

9. The milling tool of claim 5, further having a controller associated therewith adapted to control the operation of the cutting tool.

10. The milling tool of claim 9, wherein at least a portion of the controller is contained in the milling tool.

11. The milling device of claim 10 wherein the controller includes a surface controller that is in data transmission with the controller in the tool for controlling the operation of the milling tool.

12. A method of creating a window in a casing comprising:

a) running the tool of claim 5 to a selected depth;

b) activating said milling tool with a controller; including 1) causing said milling tool to follow said groove in said template while said milling tool mills said casing, said groove being in a shape of a window;

c) removing debris from said window.

13. A downhole tool comprising:

a) a template configured to be disposable downhole and adjacent a prospective window site;

b) a downhole milling tool guided by said template and includes a drive which moves said tool within a groove in said template; and c) a controller in communication with said milling tool to control operation of said milling tool.

* * * * *

UNITED STATES PATENT AND TRADEMARK OFFICE

CERTIFICATE OF CORRECTION

PATENT NO. : 6,012,526
DATED : January 11, 2000
INVENTOR(S) : Jennings et al.

It is certified that error appears in the above-identified patent and that said Letters Patent is hereby corrected as shown below:

Title page,
Item [75], Inventors, after "James", delete "Kenneth" and insert therefor -- Kennon --.

Column 1,
Line 31, after "have" delete ".".

Signed and Sealed this

Thirty-first Day of December, 2002

JAMES E. ROGAN
*Director of the United States Patent and Trademark Office*